United States Patent [19]

Frenger

[11] 3,947,679

[45] Mar. 30, 1976

[54] BOX- OR CHANNEL SHAPED LIGHTING FIXTURE FOR LIQUID COOLING

[76] Inventor: Karl Gunnar Frenger, Skovveien 33, Oslo 3, Norway

[22] Filed: Sept. 23, 1974

[21] Appl. No.: 508,607

[30] Foreign Application Priority Data

Nov. 6, 1973 Sweden ..... 73150526

[52] U.S. Cl. ..... 240/47; 98/40 DL; 240/51.11 R

[51] Int. Cl.[2] ..... F21V 29/00

[58] Field of Search ..... 240/47, 9 A, 51.11 R; 98/40 DL

[56] References Cited

UNITED STATES PATENTS

| | | | |
|---|---|---|---|
| 3,112,890 | 12/1963 | Snelling | 240/51.11 R |
| 3,193,001 | 7/1965 | Meckler | 240/9 A |
| 3,330,130 | 7/1967 | Schraith et al. | 240/51.11 R |
| 3,372,739 | 3/1968 | Kastovich et al. | 98/40 DL |
| 3,401,742 | 9/1968 | Meckler | 98/40 DL |
| 3,409,766 | 11/1968 | Meckler | 240/47 |

*Primary Examiner*—R. L. Moses

*Attorney, Agent, or Firm*—Sughrue, Rothwell, Mion Zinn & Macpeak

[57] ABSTRACT

A lighting fixture is disclosed which utilizes liquid cooling to remove heat generated by the lighting devices mounted in the fixture. The lighting fixture is removably attachable to a previously installed cooling pipe by a wedge or cam rod which engages the surface of the cooling pipe and the walls of a groove in the fixture in which the cooling pipe is disposed. The reactors and other necessary equipment for the lighting devices are mounted in a channel shaped structure which is in heat transfer relationship with the cooling pipe so as to remove heat therefrom.

5 Claims, 8 Drawing Figures

BOX- OR CHANNEL SHAPED LIGHTING FIXTURE FOR LIQUID COOLING

1. Field of Invention.

This invention relates to lighting fixtures, more particularly liquid cooled lighting fixtures containing a plurality of lighting devices.

2. Prior Art

The lighting requirements in work rooms, offices and similar have increased strongly throughout the latest decades. Such requirements can only be overcome with modern lamps (fluorescent tubes). Even the most advanced fluorescent tubes are developing a large amount of excess heat from the electrical energy consumption because only 10–20 % of the energy consumption is transformed to light. In order to improve the light efficiency, and remove and possibly utilize the developed heat, air cooling by means of venting air is much used, but air cooling requires complicated channel systems and suffers from various drawbacks. The economy and efficiency of a possible heat recovery of the vent air is limited.

One embodiment of a lighting fixture with water cooling is shown in Norwegian Pat. No. 81,659 which makes it, theoretically, possible to obtain a substantial technical improvement of both air conditioning and lighting systems, but water cooled fixtures are only used to a small extent because so far no fully satisfactory designs have been available. For instance, it appears from the U.S. Pats. Nos. 3,090,454 and 3,507,320 that such water cooled lighting fixtures are complicated. The fixture according to the lastmentioned patent comprises one downwardly open box made from aluminum or iron plate having juxtaposed cooling tube loops. The air heated by the lighting tubes circulates inside the cavity of the box but the cooling efficiency is small, amongst others owing to the very small air circulation rates and mutual radiation of the lighting tubes. The great resistance to circulating water is limiting the possibilities of use.

In U.S. Pat. No. 3,281,587 there is described a lighting fixture, in which two lighting tubes are cooled by means of a common water carrying cooling tube. In order to obtain sufficient cooling by moderate cooling water temperature, this patent shows cooling bars in contact with the lighting tubes and with a metal cooling wall which is indirectly connected to the cooling tube; the remaining cooling substantially takes place by heat radiation to the cooling wall. The cooling effect of the bars is doubtful because they are preventing air circulation around the lighting tubes so that the heat transfer by convection is reduced. Since the glass of the lighting tubes is heat insulating and very thin no cooling will take place at the point of contact outside the lighting tubes. The lighting effect of the lighting tubes is furthermore remarkably reduced owing to the screening effect of the bars contacting the tubes. In said patent it is also mentioned that the contact base may be omitted if particularly low water temperatures are used because sufficient cooling may be obtained by radiation of heat to the cooling wall. This, however, is not possible because the construction shown necessarily causes a too long and interrupted path for the heat between the cooling surfaces and the cooling tube. Moreover, it appears that the fixture housing proper is not designed for use as an effective cooling surface. It is alternatively described as made from heat insulating material. It appears from the patent that the fixtures comprise a large number of parts so that the production and mounting will be very complicated.

In all of the water cooled lighting fixtures described above, the achievement of a somewhat satisfactory cooling is dependent on the use of cooling water or other coolant of low temperature. This involves several difficulties such as the risk of condensation as well as low efficiency by use of a heat pump and/or cooling tower.

SUMMARY OF THE INVENTION

The object of the invention is to avoid the above mentioned drawbacks and create a lighting fixture which is particularly simple and may be produced at low costs, which is easy to mount, has particular economic advantages as to illumination technics and provides optimum cooling effect for two parallel lighting tubes by the use of one single, straight cooling tube.

Thus, more particularly the invention relates to a box or channel shaped lighting fixture comprising an internal cooling body for heat conducting contact with a liquid carrying, straight cooling tube which is arranged in parallel with and between two lighting tubes or two rows of lighting tubes. The cooling body is assembled from two downwardly open sheet metal channels forming the fixture box, as well as a downwardly extending partition wall between the lighting tubes, said sheet metal channels being formed at their upper portions with a groove for the cooling tube directly below the roof of the fixture box, said partition wall forming a downwardly open channel below said groove.

According to the further invention, said two sheet metal channels may be symmetrical and clamped to each other so that said two portions form the whole fixture box as well as the cooling body and surrounding the lighting tubes as well as their reactors.

In a further embodiment of the invention, the lighting tube holders of the fixture with their attachments are so arranged that the tubes are kept in a position lower than said groove.

According to the invention said groove may be somewhat deeper than the diameter of the cooling tube, and with the registering openings in the side walls of the groove for introduction of one or more preferably resilient clamping devices forcing the cooling tube downwardly into the groove. According to the invention the clamping device may be formed as a resilient lever secured to an excenter rod.

BRIEF DESCRIPTION OF THE DRAWINGS

The invention is now to be described with reference to the drawings.

DETAILED DESCRIPTION OF PREFERRED EMBODIMENT

Figure 1:
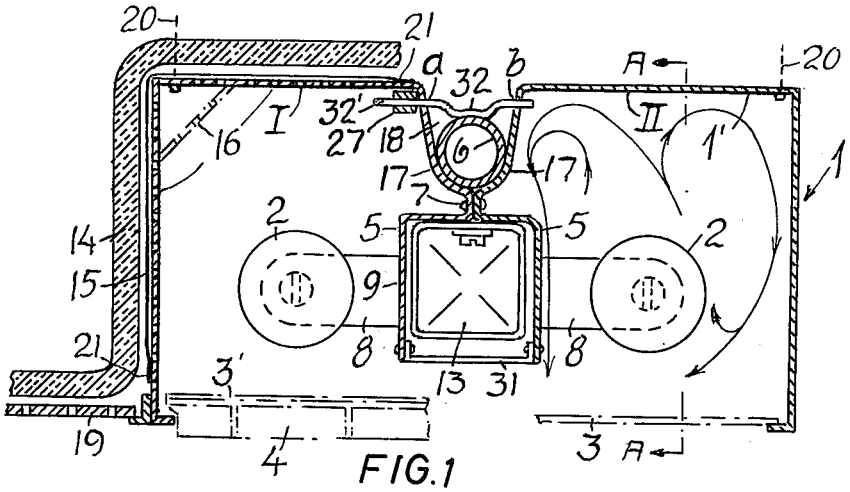
FIG. 1 shows a cross section of a lighting fixture according to the invention.

As apparent the fixture box as well as the cooling body of all the embodiments may be assembled from sheet metal channels (I and II) formed as shown in the drawing.

The designations or reference numerals used in the drawings are as follows:

1 — lighting fixture body
1' — roof of the fixture
2 — fluorescent lamps or lighting tubes
3 — transparent cover
4 — open grill
5 — partition wall (reflector wall)
6 — liquid carrying cooling tube
7 — clamping connections (such as screws, clips, spot welds, rivets or the like)
8 — holders for tubular lamps
9 — attachment for holders
12 — end wall
13 — ballast coil (reactor)
14 — heat and/or sound insulating mat
15 — foil
16 — perforations
17 — recess
18 — groove for cooling tube
19 — underceiling
20 — adjustable suspension device for the fixture
21 — sealing of the foil along the edges
22 — open end portion of the fixture box
23 — cover of opening for reactor, capacitor and connecting box
24 — channel for electric wiring
25 — opening for glow igniter
26 — clamping device - resilient lever
27 — latching socket - latching lug
28 — opening for lighting tube holder
30 — central connecting box
31 — lateral bracing of partition wall 5
32 — bracket - excenterpart - for engaging recess for cooling tube
33 — cylindric portion of clamping device
34 — tapering half cylindric portion of clamping device
36 — screw for securing of reactor
37 — stamped guide groove for clamping device
38 — separate sheet type guide groove
39 — wedge shaped clamping device of sheet metal
42 — preferably transparent guide screen for air flow The lighting fixture box according to the invention may be mass produced from rolled or stamped metal plates. The material best suited is rolled aluminum plate material having a thickness of approx. 1 mm. The plate may be eloxated prior to production, painted or spray laquered on the reflecting side and possibly perforated. In the latter case a light reflecting foil of plastic or other suitable material is provided externally of the box. This foil is fixed in airtight manner (sealed) to the fixture along the edges. Above the lighting box there may be placed a heat absorbing mat. By providing the perforated box with an open grill the fixture will act as sound proofing in a well known manner.

Figure 2:
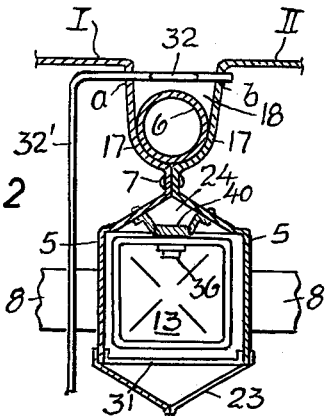
FIG. 2 shows the cross section of FIG. 1 with the resilient lever in an unclamped position.
Figure 5:
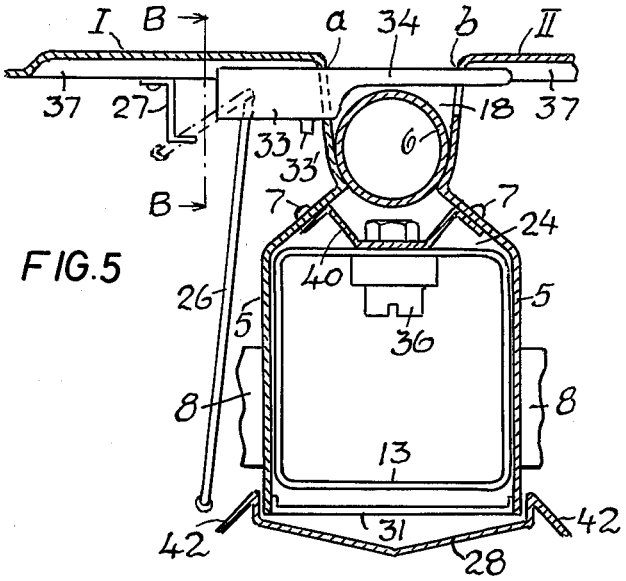
FIG. 5 shows a cross section of a portion of a lighting fixture according to the present invention with a fourth embodiment of the clamping device.

The complete fixture box 1 comprises preferably two symmetrically equal halves I and II, see FIGS. 1, 2 and 5, the opposite side walls of which are mutually connected by means of rivets, welding or similar means. Adjacent to the upper horizontal walls or roofs respectively of the boxhalves recesses have been provided forming a groove 18 in which is placed the cooling tube 6.

In order to facilitate the introduction of the cooling tube 6 into the groove 18 in the upper wall or roof of the fixture box, the walls of said groove 18 are preferably diverging.

As shown in dotted lines (FIG. 1) the two boxshaped fixture halves may have inclined side walls. In all the embodiments the separating walls 5 form a downwardly open channel below the groove 18, in which the ballast coil and all the other electric components are arranged.

For absorption of the heat generated by the electric components they are secured in heat a conducting way in the channel and as near to the groove 18 as possible, as shown in the drawings. For stiffening the side walls 5 they can be provided with bracings 31 which may consist of bent portions of the side walls.

Figure 8:
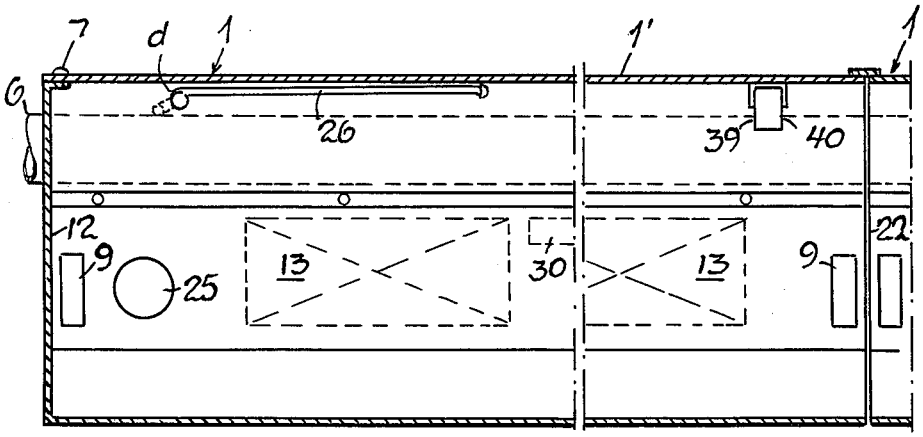
FIG. 8 shows a longitudinal section along line A—A in FIG. 1 and in principle corresponding sections of the modifications.

The fixtures may be separately arranged with intermediate connections, or they may be arranged abutting each other in the longitudinal direction to provide luminating bands. The fixtures may be provided with end walls, but they may also be made completely or partly without end walls, as shown by 22, FIG. 8.

All the embodiments permit a very fast and simple securing of prefabricated fixtures to a cooling tube system which is provided in advance below the ceiling in the room in question and which is previously pressure tested. The tube system is then preferably placed somewhat lower than its final position. The fixtures, inclusive all components except lighting tubes and grills or covers, are pushed upwardly against the cooling tubes so that these are slid into the grooves 18, the fixtures being secured to the suspension devices 20 so that the tubes preferably are resting in the grooves of the fixtures. The insulating mats are provided at a suitable time. The clamping devices shown permit a very high contact pressure between the fixtures and the cooling tubes without deformation of the relatively thin metal sheets, as well as a very fast securing to the tubes by clamping, which may be done separately when all fixtures and underceiling are finished and in location. Accordingly, it is of particular importance that the clamping onto the tubes can be made inside the fixture box itself. The fixtures may further, if necessary, be easily and individually demounted. The electric apparatus is easy to reach and detachable. In the embodiment of FIG. 1 the channel for the electric equipment (reactors, glow igniters, wires etc.) is detachably secured to the wall of the groove 18 and other components and the holders for the lighting tubes are secured on the channel. Thus, the equipment may be disassembled together with and fixed to the channel by releasable screws which may be reached from the lower side of the fixture.

Consequently, the fixtures may be arranged in any underceiling construction or freely suspended in the room.

In a simple embodiment the clamping device consists of a cylindrical metal rod of spring steel which is angularly shaped and one arm 32 of which is adapted to be inserted through openings a and b in the position shown in FIG. 2. As apparent from FIG. 1 the said first arm 32 is formed with a bending to provide a cam which, by pivoting of the other arm — the lever 32 — the necessary angle will, engage the upper side of the cooling tube 6 as the cam assumes an inclined position. The lever 32 may be curved so as to straighten when the incurved end portion of the free arm is pushed through an opening d in the side wall of the groove 18, see FIG. 8.

Figure 6:
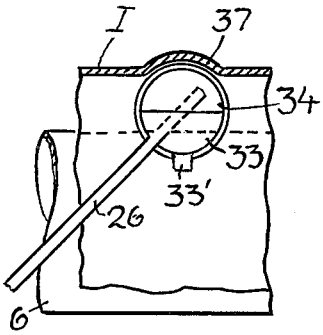
FIG. 6 shows a clamping device and guide groove in section along line B—B in FIG. 5 with the device inserted.
Figure 7:
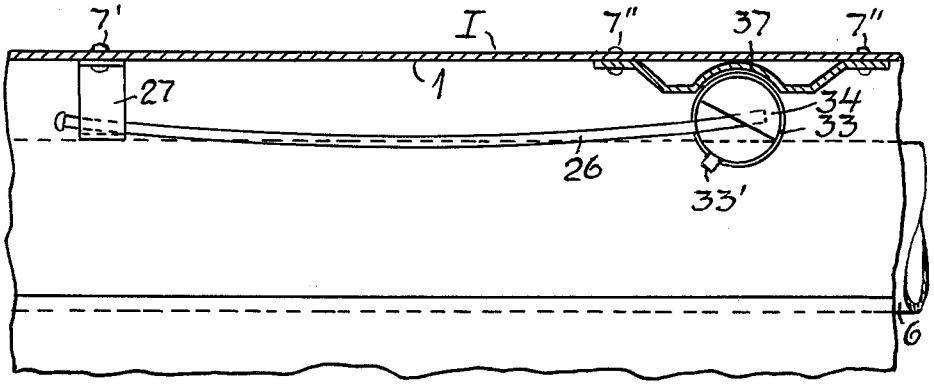
FIG. 7 shows a section of a modified guide groove with the clamping device of FIG. 5 in clamping position.

The clamping device according to FIGS. 5, 6 and 7 is formed differently from the type of FIGS. 1 and 2.

Figure 3:
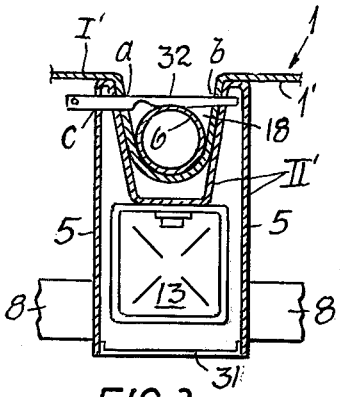
FIG. 3 shows a cross section of FIGS. 1 and 2, but with a second embodiment of the clamping device.

The excentric portion of the clamping device may be formed of a relatively thick rod of metal, PVC or similar sufficiently strong material having an approximately cylindrical portion, a preferably cylindrical portion and a stop lug. By first inserting the excentric portion through openings *a* and *b* or *a*, *b* and *c*, FIG. 3, in the position of FIG. 5 and then turning it through a suitable angle by means of the lever 26, a very high contact pressure may be obtained between the cooling tube and the groove.

The guide grooves facilitate the inserting of the excentric rod and protect the sheet metal against further deformations.

Figure 4:
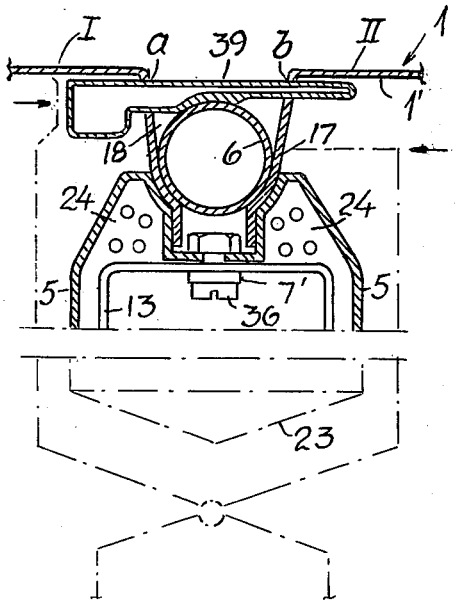
FIG. 4 shows a cross section of a portion of a lighting fixture according to the present invention, with a third embodiment of the clamping device.

The clamping device may also be a resilient wedge 39, as shown in FIG. 4 and be made of metal or PVC. The wedge 39 is initially pushed in through the openings *a* and *b* and is then forced into clamping position manually by a pair of tongs or similar tool.

The clamping devices shown may each be used for any of the embodiments shown in the drawings.

Modern lighting fixtures contain a small number of electrical components which are mostly standardized all over the world. This is particularly true with the fluorescent tubes, which for obtaining the highest possible efficiency require a surface temperature of between 35° and 50°C. This may be achieved by means of the invention by using only one cooling tube which will provide the necessary cooling of two parallel lighting tubes. Thereby, the highest possible efficiency of the cooling tube system is obtained.

Preferably the complete inner surface of the fixture box is used as an active cooling surface by heat transfer by convection and radiation. Positioning of the downwardly extending partition wall 5 directly beneath the groove 18 avoids not only the problem of mutual radiation of the two parallel lighting tubes, but also obtains a considerable absorption of the heat radiating from same. The cold partition wall causes an intensive air circulation around the lighting tubes and along the cooling walls, as indicated by the arrows in FIG. 1, thus a high heat transfer by convection is obtained. The possible cover or grid covering the bottom of the box will simultaneously be swept by a relatively cold circulating air within the fixture box, whereby heat transfer to the room is reduced or even eliminated.

During heating periods, the cooling water heated through circulation in the cooling tubes may be used for heating the room, such as by means of the so-called radiant ceilings or in radiators and/or for direct heating of fresh air (venting air). At demand for hot water of higher temperature, heat pumping may take place with very little power consumption.

Excess heat may also be carried away by known means, such as cooling machines, cooling towers, consumption water and similar means.

In order to obtain an increased cooling effect and/or the possibility of using a cooling liquid having relatively high temperature, continuous rows of fixtures (see 22, FIG. 5) may be vented longitudinally by means of ventilators, either in a closed circuit or by vent air which preferably is sucked in from the room at the end portions of the rows. Except for the vent places, in this case the cover 3 should be airtight and heat insulating.

The lighting fixture according to the invention may preferably be cooled by return water from such metallic cooling ceilings as marketed under the trademark "Frenger ceiling".

What is claimed is:

1. A box or channel-shaped lighting fixture, having an internal cooling body for heat conducting contact with a straight liquid carrying cooling tube arranged in parallel with and between two lighting tubes or rows of lighting tubes, comprising; two metal plate channels (I, II) forming the lighting fixture (1) surrounding both lighting tubes (2), said channels being formed at their junction in the upper portion thereof with an upwardly open groove (18) for engaging the cooling tube directly below the roof (1') of the fixture; a downwardly extending, double partition wall (5) located between the lighting tubes, and contacting said channels to transfer heat thereto, said double separating wall (5) forming a downwardly open channel which is located below said groove (18) and wherein reactors of the lighting tubes (2) are mounted, which reactors are fixed in heat conducting manner within the channel.

2. A lighting fixture as claimed in claim 1, in which the said two metal plate channels (I, II) are symmetrically arranged and are fixedly connected with each other at the axis of symmetry.

3. A lighting fixture as claimed in claim 1, in which holders (8) for the lighting tubes with their fixtures (9) are mounted such that the lighting tubes (2) are in a position lower than said groove (18).

4. A lighting fixture as claimed in claim 1, in which the depth of said groove (18) is greater than the diameter of the cooling tube and wherein the side walls of the groove have aligned openings therethrough disposed below the upper wall (1') for introduction of at least one resilient clamping device which engages the cooling tube so as to force the cooling tube (6) downwardly into the groove, said clamping device being introduced from the interior of the fixture box.

5. A lighting fixture as claimed in claim 4, in which the clamping device comprises a resilient rod pivotally attached connected with an excenter rod (32 or 34) at right angle to same.

* * * * *